US005851127A

United States Patent [19]

Huang

[11] Patent Number: 5,851,127

[45] Date of Patent: Dec. 22, 1998

[54] CHRISTMAS LAMP PLUG

[76] Inventor: Shun-Feng Huang, No. 13, Lane 84, Nei Hu Road, Hsin-Chu City, Taiwan

[21] Appl. No.: 794,444

[22] Filed: Feb. 4, 1997

[51] Int. Cl.[6] ..... H01R 13/68

[52] U.S. Cl. ..... 439/622; 439/145

[58] Field of Search ..... 439/622, 621, 439/145, 143

[56] References Cited

U.S. PATENT DOCUMENTS

| | | | |
|---|---|---|---|
| 4,435,032 | 3/1984 | Abramson et al. | 439/145 |
| 4,768,979 | 9/1988 | Wu | 439/622 |
| 4,834,664 | 5/1989 | Lin | 439/145 |
| 5,069,630 | 12/1991 | Tseng et al. | 439/145 |
| 5,281,943 | 1/1994 | Liao | 439/622 |
| 5,482,478 | 1/1996 | Liao | 439/622 |

*Primary Examiner*—Gary F. Paumen
*Attorney, Agent, or Firm*—Rosenberg, Klein & Bilker

[57] ABSTRACT

A Christmas lamp plug is provided that has a body, a housing, a compressible rod and shield unit. The body has an inner open space on two leads for receiving a compressible rod. The two ends of the rod extend out of the body. The housing has two openings in a rear peripheral wall for receiving two projecting blocks therein. By pressing the ends of the compressible rod, two blade slots of the compressible rod may be displaced into correspondence with two blade slots of a rear vertical wall of the body. The shield unit consists of a movable shield, an elastic shield, and a spring to bias the elastic shield. The movable shield can be moved out of the front side of the housing, and the elastic shield can be moved to the position of the movable shield to close an upper opening of the housing, for protecting a fuse in the body.

1 Claim, 10 Drawing Sheets

CHRISTMAS LAMP PLUG

BACKGROUND OF THE INVENTION

1. Field of the Invention

This invention is directed to a Christmas lamp plug. Particularly, this invention is provided with two safe blade holes and double shields for protecting a fuse, thereby providing improved safety for a Christmas lamp plug.

2. Prior Art

A known conventional Christmas lamp plug shown in FIGS. 9 and 10 has two blade holes for receiving two blades of another Christmas lamp plug. The conventional Christmas lamp plug includes a body 5, and a housing 6 containing the body 5.

The body 5 has two hollow spaces at two longitudinal sides for respectively receiving two metal blades 51, 51 having a sidewise projecting plate 53 facing toward a metal plate 55 for a fuse 56 to be interposed between the plate 53 and the metal plate 55. The whole body 5 can be placed in the housing 6 and kept firmly together. Further, a movable shield 61 is provided in the housing 6 in a corresponding location of the fuse 56 so as to be opened for displacing the fuse 56.

Various disadvantages have been found, after using the known conventional Christmas lamp plug, such as:

1. The blade holes for a plug are not covered, presenting a possible danger of some object or a finger entering through the blade holes into the body, to cause short-circuit.
2. The movable shield is liable to drop off or be left open, exposing the fuse. Should a playful child place a hand into the body, he/she would be electrocuted.

SUMMARY OF THE INVENTION

The main purpose of the invention is to offer a Christmas lamp plug with an improved structure. The Christmas lamp includes a compressible rod in a body for opening and closing two blade holes, thereby preventing any exterior objections from entering the body. When the ends of the compressible rod are pushed sidewise, two slots in the compressible rod communicate with the two blade holes so as to permit two metal blades of another plug to pass into the body.

Another purpose of the invention is to offer a Christmas lamp plug that includes a movable shield, and an elastic shield located behind the movable shield and biased by a spring. The elastic shield can be automatically moved by the spring to close an upper opening under which a fuse is located, if the movable shield for closing the upper opening is moved out or does not close the upper opening correctly.

BRIEF DESCRIPTION OF THE DRAWINGS

This invention will be better understood by referring to the accompanying drawings, wherein.

DESCRIPTION OF THE PREFERRED EMBODIMENT

Figure 1:
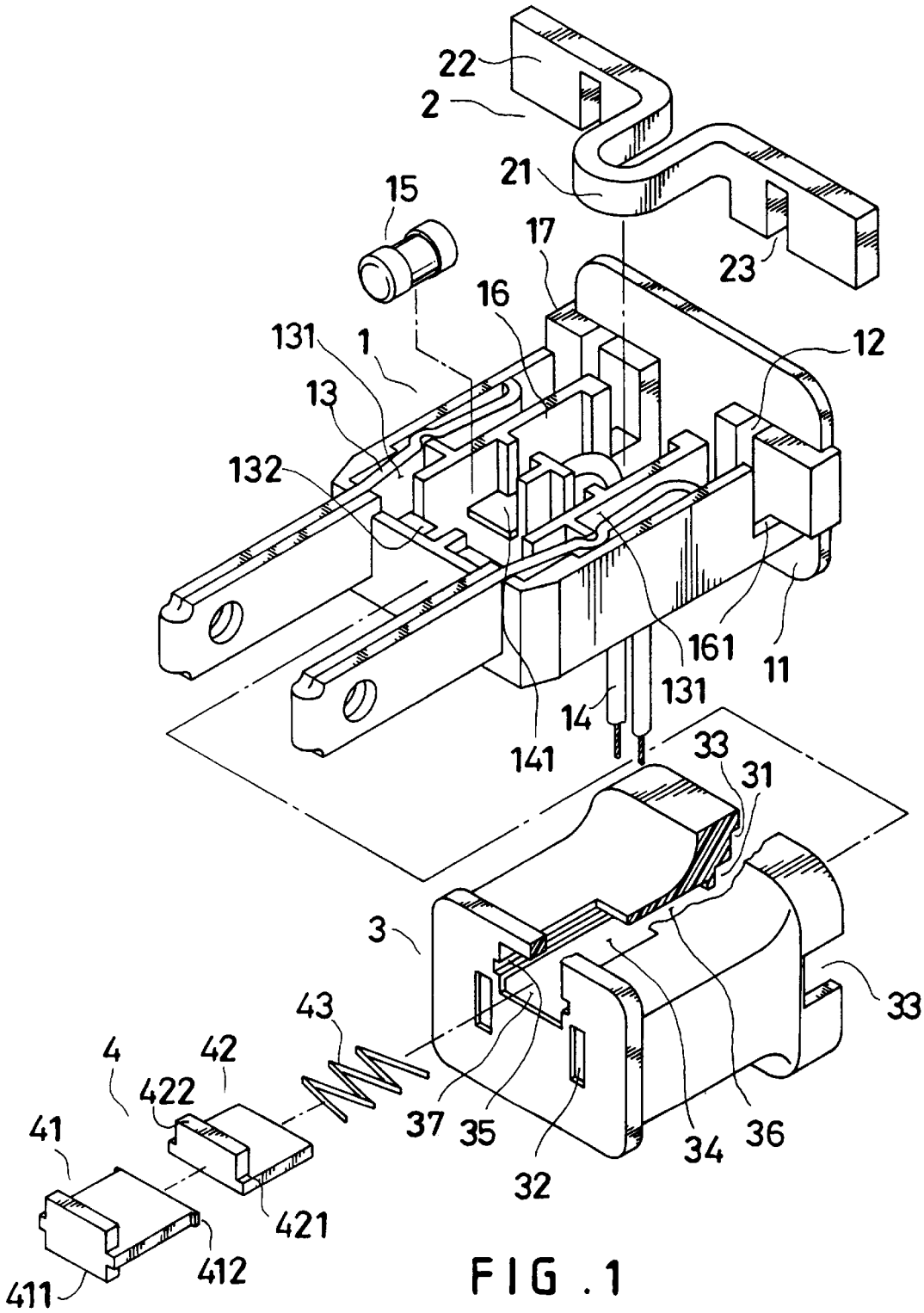
FIG. 1 is an exploded perspective view of a preferred embodiment of a Christmas lamp plug of the present invention.

A Christmas lamp plug of the present invention, as shown in FIG. 1 includes a body 1, a compressible rod 2, a housing 3 and a shield unit 4 as main components that are combined together.

Figure 2:
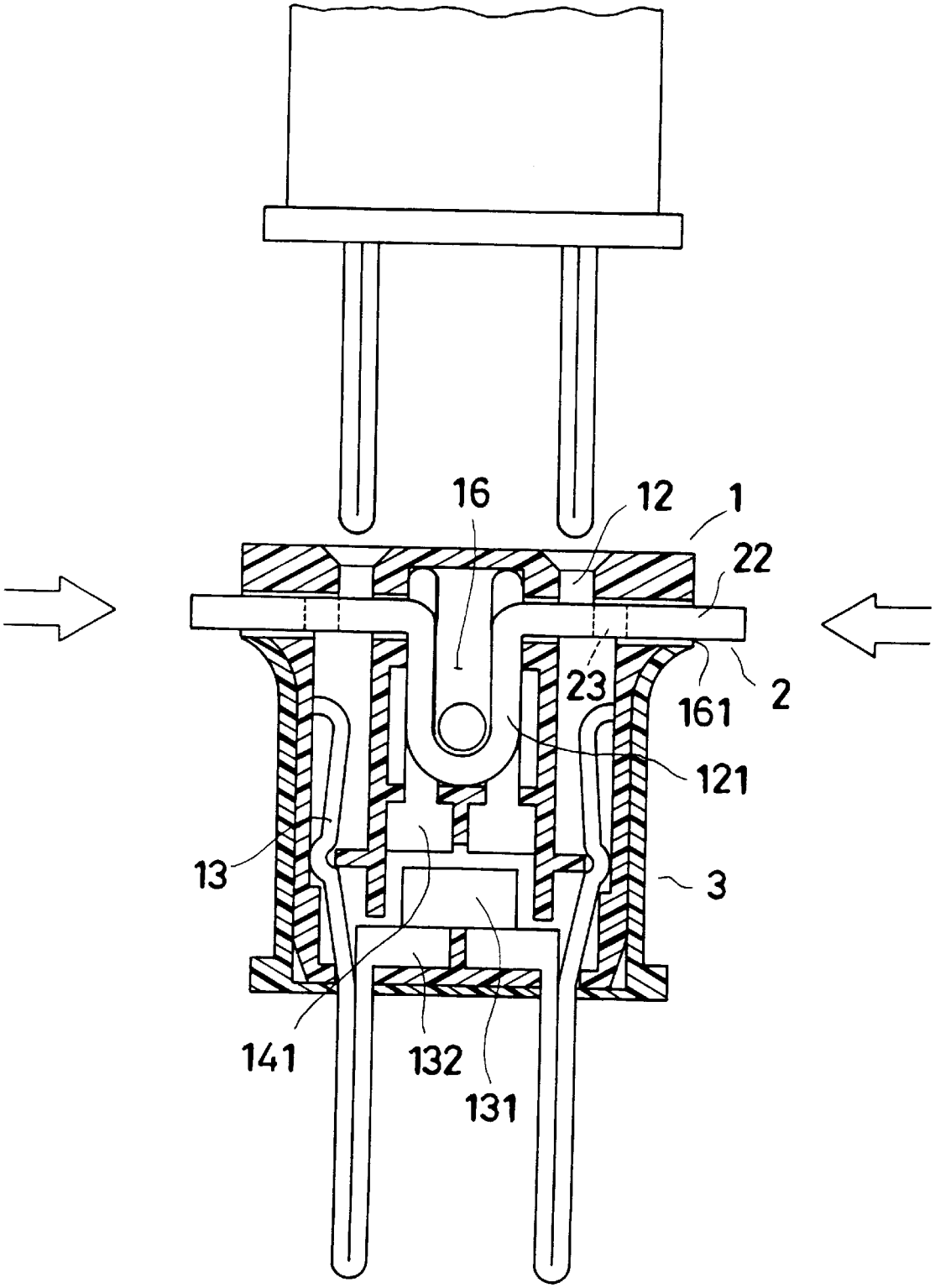
FIG. 2 is a front cross-sectional view of the Christmas lamp plug of the present invention, showing it not yet receiving a plug.

The body 1, as shown in FIGS. 1 and 2, has a rear vertical wall 11, two opposite vertical slots 12, 12 in the vertical wall 11, two parallel metal blades 13, 13 fitted in two elongated spaces 131, 131 located in front of the two vertical slots 12, 12. Each metal blade 13 has a projecting-inward plate 132 facing toward a terminal plate 141 of a lead 14, so that a fuse 15 may be placed between the projecting plate 132 and the terminal plate 141 for electricity to pass therethrough to light a Christmas lamp. An open space 16 is provided into which each of the two leads 14, 14 extend. The body has a lateral opening 161 respectively extending from the open space 16 to each of two sides thereof. A projecting block 17 is provided on the vertical wall 11 at two sides thereof, facing toward a respective lateral opening 161.

The compressible rod 2 has an intermediate U-shaped elastic portion 21 just fitting in the open space 16 of the body 1. The compressible rod 2 has two side press portions 22, 22 that fit into the two lateral openings 161, 161 and protrude out a small amount from the two sides of the body 1. Each side press portion 22 has a vertical slot 23 formed therein and open on one side thereof.

The housing 3 has an inner hollow space 31 for receiving the body 1 therein and two spaced-apart vertical slots 32, 32 in a front wall for the metal blades 13, 13 to protrude out therefrom.

The housing 3 further has two openings 33, 33 in a rear vertical peripheral wall for receiving the two projecting blocks 17, 17 of the body 1 therein. Further, the housing 3 has an upper opening 34 in an upper wall in correspondence with the fuse 15 in the body 1, and a longitudinal guide groove 35 respectively provided in two opposite side walls defining the inner space 31 just under the upper opening 34. Still further, an upper space 36 is formed to communicate with the inner space 31, and a front opening 37 formed in a front vertical wall, in front of the two guide longitudinal grooves 35, 35.

The shield unit 4 consists of a movable shield 41, an elastic shield 42 and a spring 43. The movable shield 41 has nearly a T-shaped contour, a stop wall 411 formed at a front side and two opposite engage points 412, 412 formed at a rear side. The two longitudinal sides of the movable shield 41 fit into the two longitudinal guide grooves 35, 35, and are able to slide in through the front opening 37 to form a closure for the upper opening 34 of the housing 3. The movable shield 41 is moved out of the front opening 37 for inserting the fuse 15 into the body 1. The elastic shield 42 and the spring 43 are sequentially placed in the upper space 36 of the housing. The elastic member 42 has two projections 421, 421 on opposing sides of a lower end of a front vertical wall 422 for fitting and sliding back and forth in the two guide grooves 35, 35, with the vertical wall 422 able to be in contact with the movable shield 41.

Figure 5:
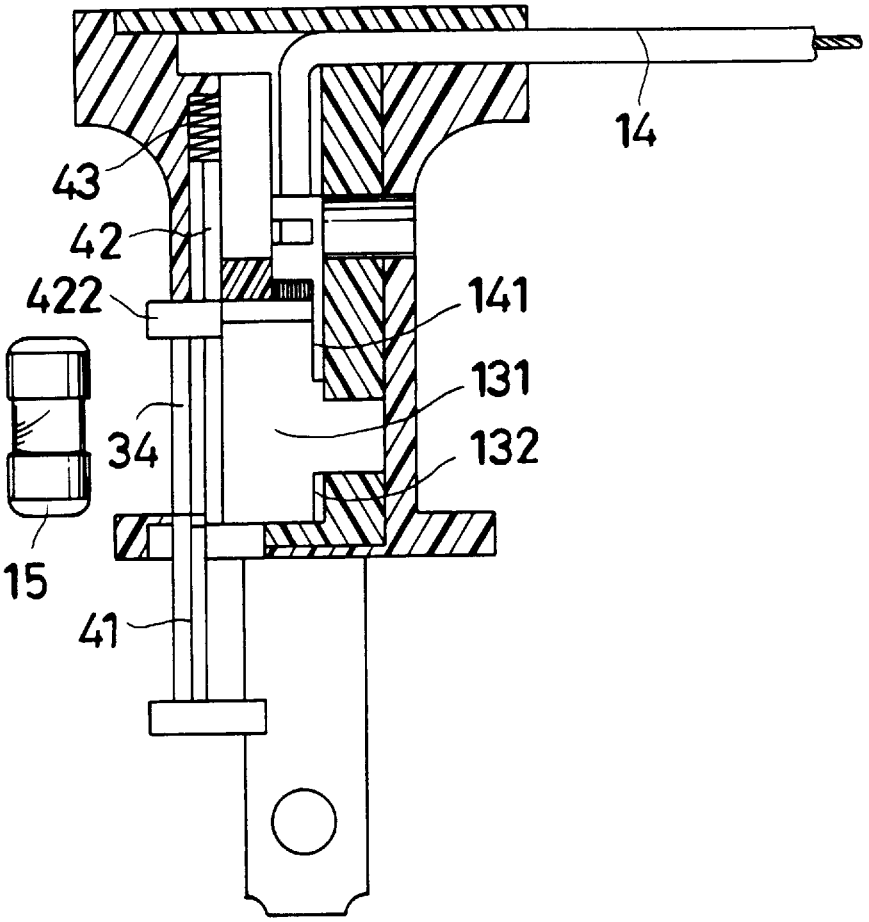
FIG. 5 is a first side cross-sectional view of the Christmas lamp plug of the present invention, showing a movable shield opened for inserting a fuse into the body.
Figure 6:
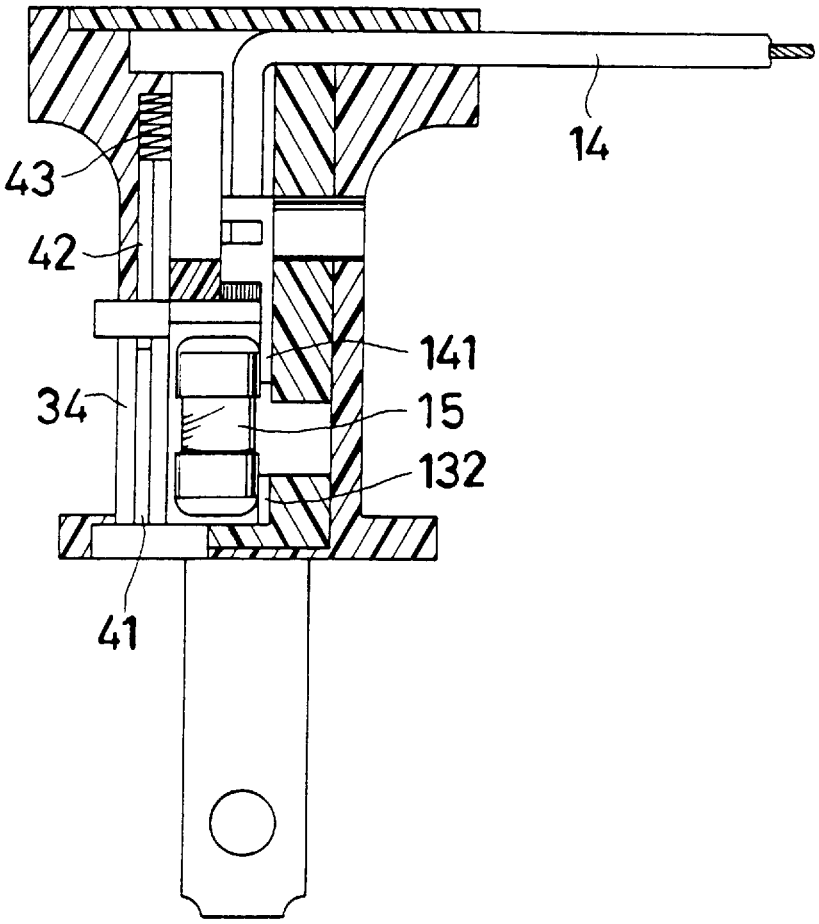
FIG. 6 is a second side cross-sectional view of the Christmas lamp plug of the present invention, showing the fuse inserted in the body and the movable shield closed on the fuse.
Figure 7:
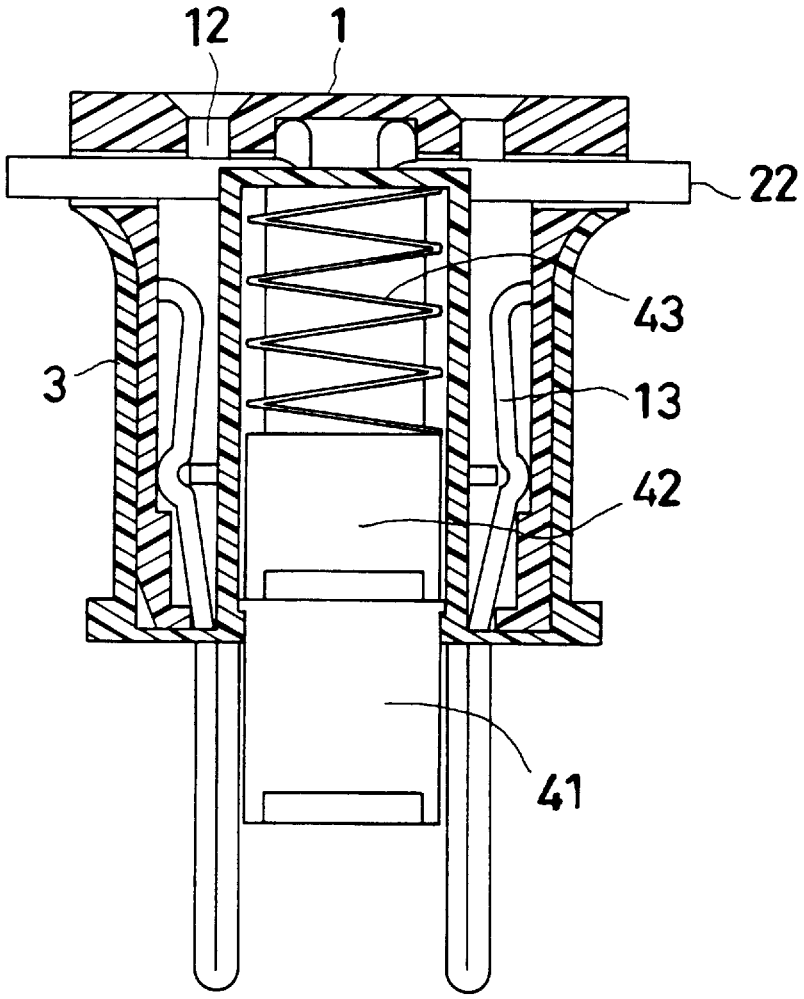
FIG. 7 is another front cross-sectional view of the Christmas lamp plug of the present invention.
Figure 8:
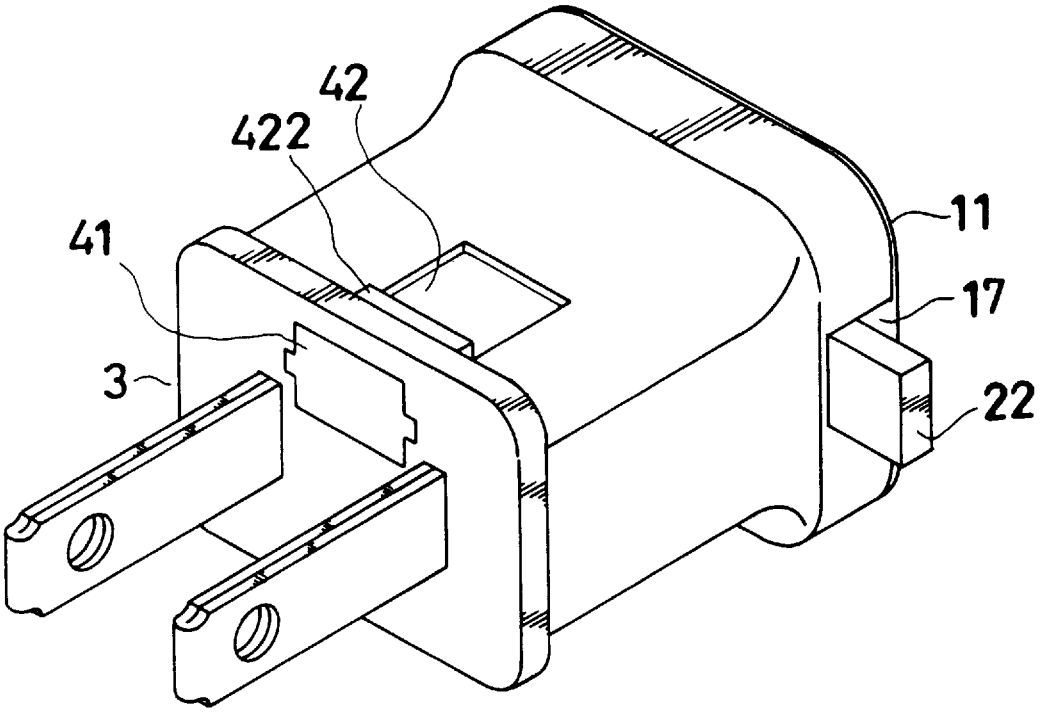
FIG. 8 is a perspective view of the Christmas lamp plug of the present invention.
Figure 9:
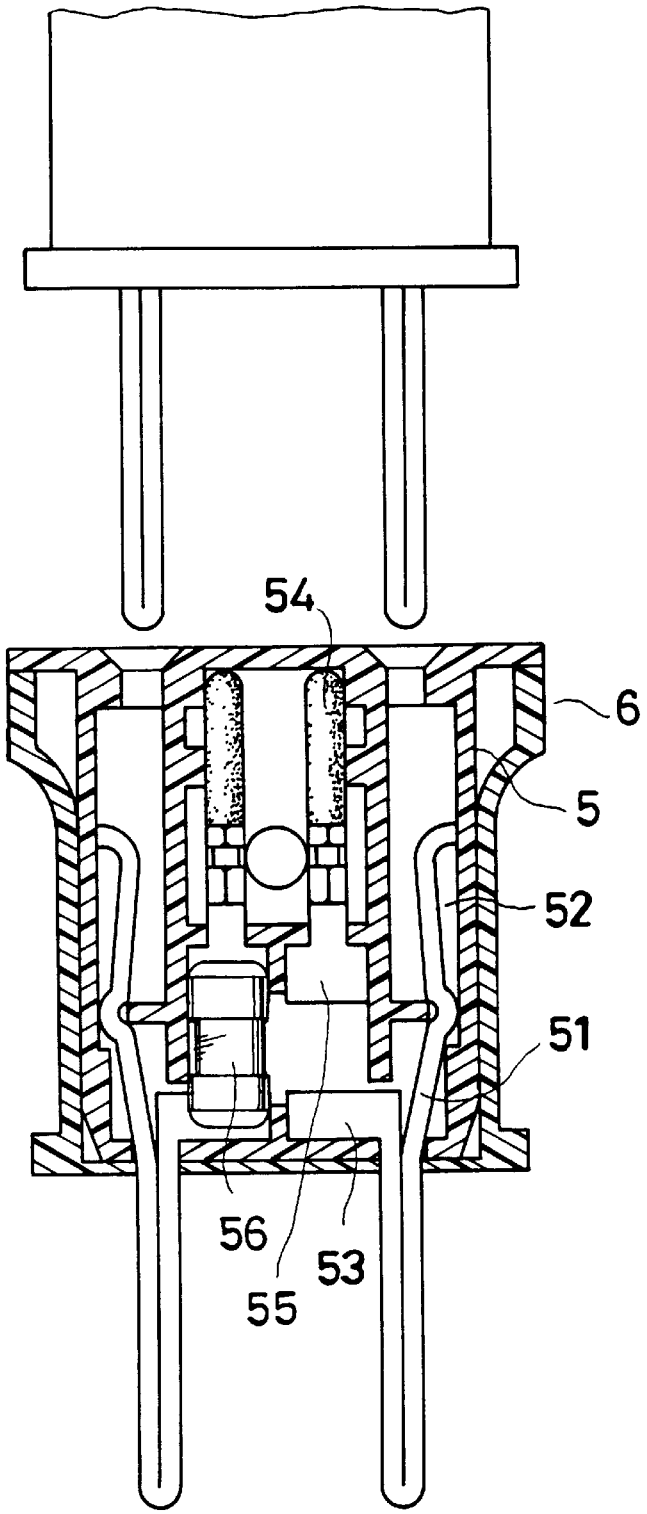
FIG. 9 (PRIOR ART)
FIG. 9 is a front cross-sectional view of a known conventional Christmas lamp plug; and, FIG. 10 is a side cross-sectional view of the known conventional Christmas lamp plug.
Figure 10:
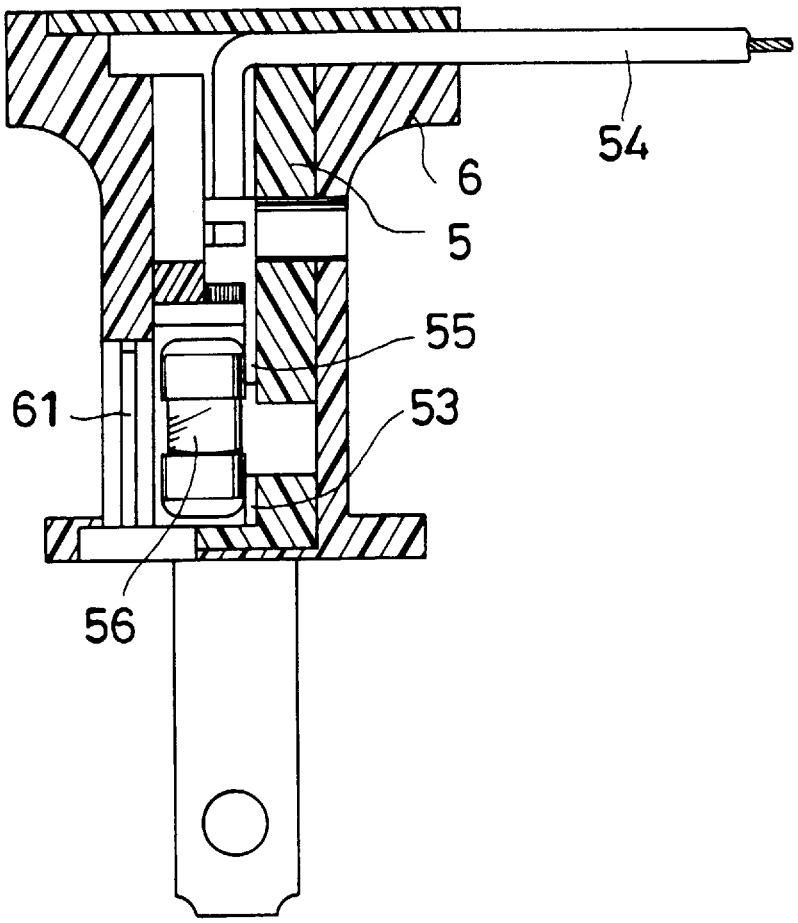
FIG. 10 (PRIOR ART)

In assembly, referring to FIGS. 2–7, the compressible rod 2 is placed in the body 1, with the press portions 22 extending through the lateral openings 161, 161. The compressible rod 2 together with the body 1 is inserted into the housing 2, with the metal blades 13, 13 protruding out of the vertical slots 32, 32 for insertion into a socket. The two projecting blocks 17 are inserted into the openings 33, 33 of the housing 3, with the rear vertical wall 11 being positioned flush with the rear side of the housing 3 and integral therewith by adhering one to the other. The spring 43, the elastic shield 42 are sequentially placed in the upper space 36, with the two sides of the shield 42 inserted into the guide grooves 35, 35. The movable shield 41 forms a closure for the upper opening 34, with two sides thereof inserted into the guide grooves 35, 35 as shown in FIG. 6.

Figure 3:
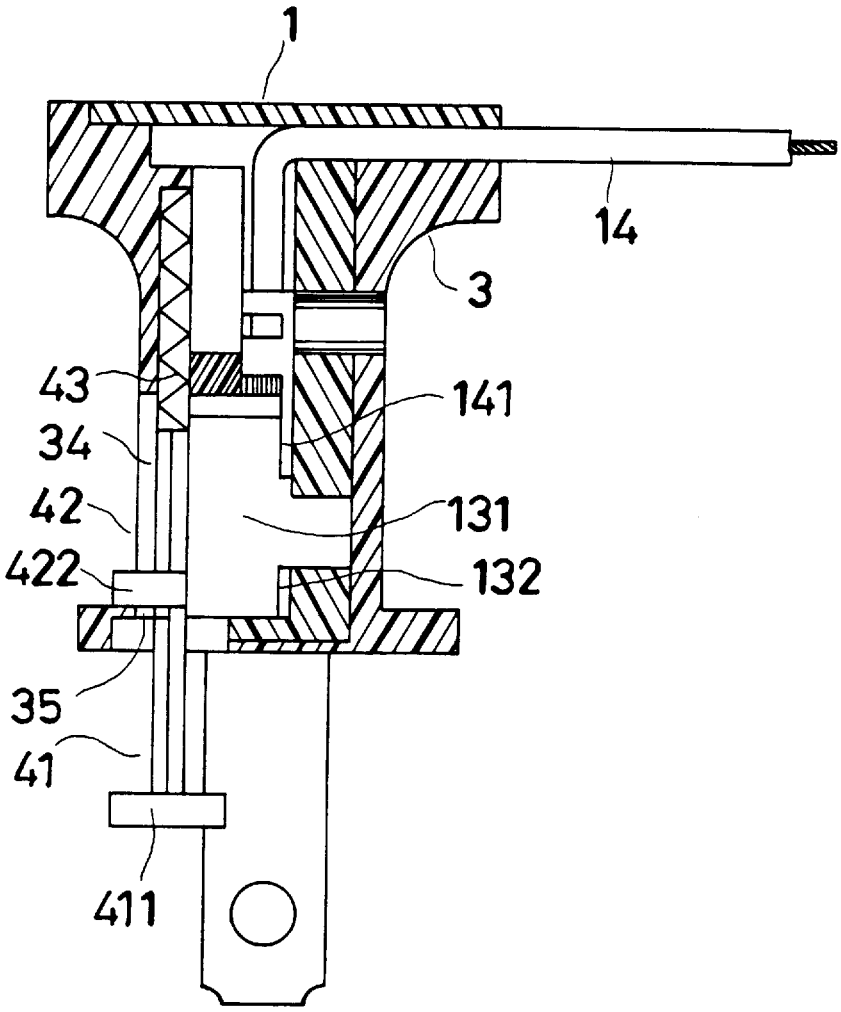
FIG. 3 is a side cross-sectional view of the Christmas lamp plug of the present invention.
Figure 4:
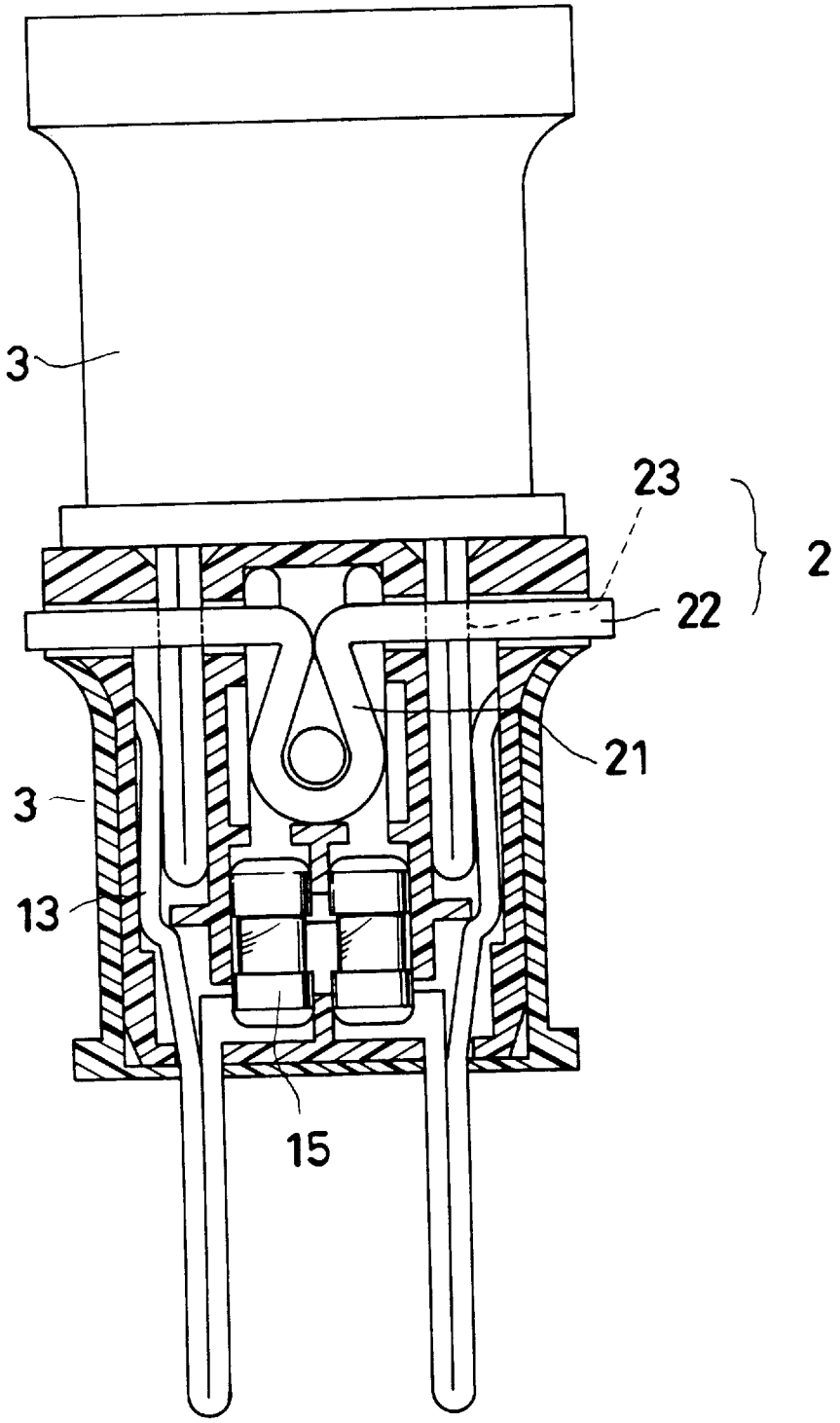
FIG. 4 is a front cross-sectional view of the Christmas lamp plug of the present invention, showing an inserted plug.

If the movable shield 41 is pulled out of the front opening 37 and exposes the upper opening 34, the elastic member 42 consequently moves to close the upper opening 34 at once, urged by the spring 43. By that arrangement, the upper opening 34 is always closed, either by the movable shield 41 or the elastic shield 42, preventing any object from entering the opening 34 and touching an electrical component, as shown in FIG. 3. In the event that the fuse 15 needs to be replaced with a new one, the elastic member 42 is pushed inward to open the upper opening, as shown in FIG. 5.

As can be understood from the above description, the Christmas lamp plug has the following advantages over the known conventional ones.

1. The compressible rod normally closes up the blade holes, preventing exterior objects from entering the body, guaranteeing safety of the plug.

2. The upper opening 34 on the fuse is always closed by either the movable shield or the elastic shield, preventing any object or finger from entering the body to cause a short-circuit or electrocution.

3. Even if the movable shield 41 were to fall off or is not pushed sufficiently to close the opening 34, the elastic shield 42 is moved elastically by the spring 43 to close the opening 34, guaranteeing double safety of the plug.

While the preferred embodiment has been described above, it will be recognized and understood that various modifications may be made therein and the appended claims are intended to cover all such modifications which may fall within the spirit and scope of the invention.

What is claimed is:

1. A Christmas lamp plug comprising:

a body having a rear vertical wall, with two vertical slots formed in said rear vertical wall in parallel relationship, and two metal blades disposed in two parallel elongated spaced facing toward said rear vertical slots, each of said two metal blades having a projecting plate extending inwardly to contact one end of a fuse, said body having (a) two open divided spaces on two opposing sides thereof, (b) two lateral openings formed through opposing sides thereof and in respective open communication with said two open spaces, and (c) a projecting block facing a respective one of said two lateral openings in said rear vertical wall;

a housing having an inner hollow space for receiving said body therein, said housing having two slots formed in a front vertical wall thereof for said metal blades to extend therethrough, and an upper opening in a front portion of an upper wall of said housing for insertion of said fuse into said body, said housing having a front opening for a movable shield of a shield unit to move in and out, said housing having two opposing openings formed in a rear vertical peripheral wall for receiving said two projecting blocks of said body therein, said inner hollow space having two longitudinal side walls, each of said longitudinal side walls having a longitudinal guide groove formed therein, said housing having an upper space communicating with said inner hollow space and located in correspondence with said front opening;

a compressible rod having an intermediate U-shaped elastic portion disposed in said body, said compressible rod having two side press portions extending from said intermediate U-shaped elastic portion, each said side press portion having a vertical slot formed therein and open to an edge thereof, each said side press portion extending through a respective one of said lateral openings of said body and extending therefrom;

said shield unit consisting of said movable shield, an elastic shield and a spring in an upper space of said housing with two sides of said elastic shield disposed in said two longitudinal grooves of said housing, said movable shield having a front vertical wall and two opposing projections at a rear side and located longitudinally in front of said elastic shield for closing said upper opening of said housing, said elastic shield having a front vertical wall and two opposing projections at two bottom sides of said front vertical wall to contact said two opposing projections of said movable shield; and said elastic shield being displaced by a bias force of said spring and closing said upper opening of said housing responsive to said movable shield being removed from said front vertical wall through said front opening of said housing.

* * * * *